US008210228B2

(12) United States Patent
Kirby et al.

(10) Patent No.: US 8,210,228 B2
(45) **Date of Patent: *Jul. 3, 2012**

(54) ROLLER SHADE SYSTEM HAVING A PLEATED SHADE FABRIC

(75) Inventors: David A. Kirby, Zionsville, PA (US); Matthew R. Hontz, Allentown, PA (US)

(73) Assignee: Lutron Electronics Co., Inc., Coopersburg, PA (US)

( * ) Notice: Subject to any disclaimer, the term of this patent is extended or adjusted under 35 U.S.C. 154(b) by 300 days.

This patent is subject to a terminal disclaimer.

(21) Appl. No.: 12/609,704

(22) Filed: Oct. 30, 2009

(65) Prior Publication Data

US 2010/0043985 A1 Feb. 25, 2010

Related U.S. Application Data

(63) Continuation-in-part of application No. 12/193,089, filed on Aug. 18, 2008, now Pat. No. 7,802,609, and a continuation-in-part of application No. 12/430,458, filed on Apr. 27, 2009, now Pat. No. 8,042,597.

(51) Int. Cl.

| | |
|---|---|
| ***A47G 5/02*** | (2006.01) |
| ***A47H 1/00*** | (2006.01) |
| ***A47H 13/14*** | (2006.01) |
| ***A47H 23/01*** | (2006.01) |

(52) U.S. Cl. ..... 160/238; 160/348; 160/349.1; 160/310

(58) Field of Classification Search ..... 160/310, 160/348, 238, 352, 23.1, 32, 84.01; 242/615, 242/615.3; 223/85, 95, 88, 96, 28–36; 38/12, 38/102.91; 112/147, 145, 146; 493/427, 493/442, 480, 446–448

See application file for complete search history.

(56) References Cited

U.S. PATENT DOCUMENTS 85,922 A 1/1869 Fuzzard (Continued)

FOREIGN PATENT DOCUMENTS

GB 2112273 A 5/2010

OTHER PUBLICATIONS

European Patent Office, International Search Report and Written Opinion for International Patent Application No. PCT/US2009/053393, Jul. 7, 2011, 10 pages.

(Continued)

*Primary Examiner* — Blair M Johnson
*Assistant Examiner* — Jaime F Cardenas-Garcia
(74) *Attorney, Agent, or Firm* — Mark E. Rose; Philip N. Smith; Bridget L. McDonough

(57) ABSTRACT

A pleated roller shade system allows a thin flexible shade fabric, such as, for example, silk, to be wrapped around a roller tube. The pleated roller shade system comprises a drive system, such as a motor or manual drive system, for controlling of the rotation of the roller tube. The roller shade system may comprise a pleating hem bar that is contained within a hem bar pocket of the shade fabric and has a non-linear shape for causing the shade fabric to hang with a plurality of pleats. The roller shade system may also comprise an elongated pleating assembly mounted parallel to the roller tube and having a fabric-receiving opening that defines a non-linear path. The shade fabric may be received through the fabric-receiving opening and folded by the pleating assembly, such that the shade fabric is wrapped around the roller tube in folds as the roller tube rotates. The pleating assembly includes a plurality of pleating elements that each have a T-shaped or funnel-shaped structure for causing the shade fabric to hang with the pleats.

30 Claims, 13 Drawing Sheets

U.S. PATENT DOCUMENTS

| | | | |
|---|---|---|---|
| 128,722 | A | 7/1872 | Gird |
| 1,549,535 | A | 8/1925 | Gray |
| 3,116,097 | A | 12/1963 | Novales |
| 3,160,202 | A | 12/1964 | Rosen |
| 3,783,456 | A | 1/1974 | Doan |
| 3,784,186 | A | 1/1974 | Lenthall et al. |
| 5,467,266 | A | 11/1995 | Jacobs et al. |
| 6,100,659 | A | 8/2000 | Will et al. |
| 6,155,326 | A | 12/2000 | Imhoff et al. |
| 6,201,364 | B1 | 3/2001 | Will et al. |
| 6,497,267 | B1 | 12/2002 | Azar et al. |
| 6,845,806 | B2 | 1/2005 | Gottschall et al. |
| 6,983,783 | B2 | 1/2006 | Carmen, Jr. et al. |
| 7,063,124 | B2 | 6/2006 | Walker et al. |
| 7,163,044 | B2 | 1/2007 | Kirby |
| 7,281,565 | B2 | 10/2007 | Carmen, Jr. et al. |
| 7,802,609 | B2 | 9/2010 | Kirby |
| 2005/0205217 | A1 | 9/2005 | Harper et al. |
| 2008/0121353 | A1 | 5/2008 | Detmer |
| 2010/0038039 | A1 | 2/2010 | Kirby |
| 2010/0269983 | A1 | 10/2010 | Kirby |
| 2010/0314052 | A1 | 12/2010 | Kirby |

OTHER PUBLICATIONS

U.S. Appl. No. 12/430,458, filed Apr. 27, 2009, David A. Kirby.

ROLLER SHADE SYSTEM HAVING A PLEATED SHADE FABRIC

CROSS REFERENCE TO RELATED APPLICATIONS

The present application is a continuation-in-part of, commonly-assigned U.S. patent application Ser. No. 12/193,089, filed Aug. 18, 2008, now U.S. Pat. No. 7,802,609, entitled ROLLER SHADE SYSTEM HAVING A PLEATED FABRIC, and U.S. patent application Ser. No. 12/430,458, filed Apr. 27, 2009, now U.S. Pat. No. 8,042,597, entitled ROLLER SHADE SYSTEM HAVING A HEM BAR FOR PLEATING A SHADE FABRIC. The entire disclosures of both applications are hereby incorporated by reference.

BACKGROUND OF THE INVENTION

1. Field of the Invention

The present invention relates to a motorized window treatment, and more particularly, to a motorized roller shade system for winding receipt of a thin, pleated fabric around a roller tube.

2. Description of the Related Art

Typical window treatments, such as, for example, roller shades, draperies, roman shades, and venetian blinds, are mounted in front of windows to prevent sunlight from entering a space and to provide privacy. A roller shade includes a flexible shade fabric wound onto an elongated roller tube. The flexible shade fabric typically includes a weighted hem bar at a lower end of the shade fabric, such that the shade fabric hangs in front of the window. Motorized roller shades include a drive system engaging the roller tube to provide for tube rotation, such that the lower end of the shade fabric can be raised and lowered (i.e., moved in a vertical direction) by rotating the roller tube.

Many thin and flexible fabrics, such as, for example, silk, are not suitable for use with prior art roller shades, since the thin fabrics tend to not hang flat and tend not to roll up evenly on the roller tube. Therefore, such thin fabrics are typically laminated to a stiffer backing to be wound about a roller tube. While the lamination allows the thin fabrics to be used with a roller shade, the thin fabrics loose their soft look and feel as a result of this process.

Prior art draperies have allowed for horizontal movement of a suspended pleated drapery fabric covering a window or other opening. These prior art draperies have required additional space to be provided on the sides of the window or opening to hold the drapery fabric when the drapery is fully open. This prevents the draperies from being used to cover windows where there is little space at the sides of the windows.

Accordingly, there is a need for a roller shade system having a thin, flexible shade fabric that allows the shade fabric to hang with pleats and to be wrapped around a roller tube (i.e., moved in a vertical direction).

SUMMARY OF THE INVENTION

According to a first embodiment of the present invention, a roller shade system comprises a rotatably-mounted roller tube, a flexible shade fabric windingly received around the roller tube, a drive system coupled to the roller tube for controlling the rotation of the roller tube, and an elongated pleating assembly for causing the shade fabric to wrap in folds around the roller tube as the drive system rotates the roller tube. The shade fabric has a first fabric end connected to the roller tube and a second fabric end opposite the first fabric end and adapted to move in an upwards direction and in a downwards direction as the roller tube is rotated in respective first and second directions. The elongated pleating assembly defines a fabric-receiving opening and is mounted such that the shade fabric is received through the fabric-receiving opening. The pleating assembly is adapted to fold the shade fabric, such that the shade fabric is wrapped around the roller tube in folds as the drive system rotates the roller tube in the first direction to move the second fabric end of the shade fabric in the upwards direction. The shade fabric comprises a hem bar pocket at the second fabric end for holding a weighting element.

According to a second embodiment of the present invention, a roller shade system comprises a rotatably-mounted roller tube, a drive system coupled to the roller tube for controlling the rotation of the roller tube, a flexible shade fabric windingly received around the roller tube, and a pleating hem bar contained within a hem bar pocket at a second fabric end of the shade fabric and characterized by a non-linear shape for causing the shade fabric to hang with a plurality of pleats. The second fabric end is adapted to move in an upward direction and in a downwards direction as the drive system rotates the roller tube in respective first and second directions.

In addition, a pleating bar for a roller shade system having a flexible shade fabric windingly received around a rotatably-mounted roller tube is described herein. The pleating bar comprises first and second support bars oriented parallel to each other along a longitudinal axis of the pleating bar, and a plurality of pleating elements mounted to the first and second support bars and spaced at intervals from each other. The pleating elements are coupled to the first and second support bars extending towards the second and first support bars, respectively. The pleating elements each comprise a projection defining a funnel-shaped structure. The support bars are spaced from each other such that a fabric-receiving opening is formed between the pleating elements and defines a non-linear path.

Other features and advantages of the present invention will become apparent from the following description of the invention that refers to the accompanying drawings.

BRIEF DESCRIPTION OF THE DRAWINGS

The invention will now be described in greater detail in the following detailed description with reference to the drawings in which.

DETAILED DESCRIPTION OF THE INVENTION

Figure 1:
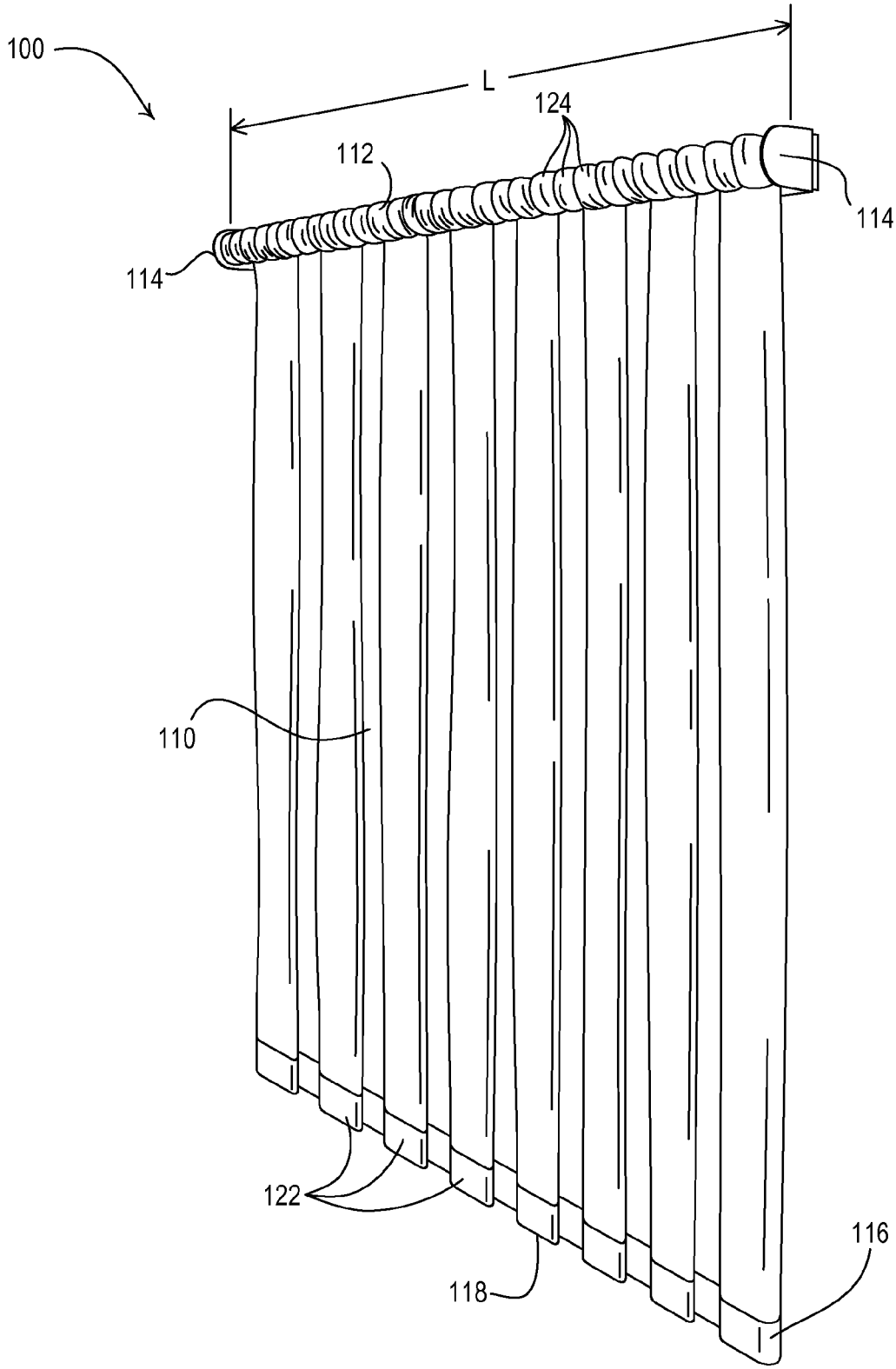
FIG. 1 is a perspective view of a pleated roller shade system having a pleated shade fabric according to a first embodiment of the present invention.

The foregoing summary, as well as the following detailed description of the embodiments of the present invention, is better understood when read in conjunction with the appended drawings. For the purposes of illustrating the invention, there is shown in the drawings an embodiment that is presently preferred, in which like numerals represent similar parts throughout the several views of the drawings, it being understood, however, that the invention is not limited to the specific methods and instrumentalities disclosed.

FIG. 1 is a perspective view of a pleated roller shade system 100 having a pleated shade fabric 110 that is windingly received around a roller tube 112 according to a first embodiment of the present invention. The shade fabric 110 has a first fabric end connected to the roller tube and a second fabric end opposite the first fabric end. The roller tube 112 has two opposite tube ends and extends between the opposite tube ends for a length L (as shown in FIG. 1). The roller tube 112 is rotatably coupled at the tube ends to two mounting brackets 114, which are connected to a vertical surface, e.g., a wall. The shade fabric 110 comprises a hem bar pocket 116 at a bottom edge 118 (i.e., the second fabric end) of the shade fabric. The bottom edge 118 of the shade fabric 110 moves in an upward direction and in a downwards direction as the roller tube 112 rotates in respective first and second angular directions.

The pleated roller shade system 100 may also comprise a drive system to provide for control of the rotation of the roller tube 112 by a user of the roller shade system. The drive system may comprise a motor drive system comprising an electronic drive unit 490 (FIG. 11), which may be mounted inside the roller tube 112. An example of a motor drive system is described in greater detail in U.S. Pat. No. 6,983,783, issued Jan. 10, 2006, entitled MOTORIZED SHADE CONTROL SYSTEM, the entire disclosure of which is hereby incorporated by reference. Alternatively, the drive system could comprise a manual drive system having a manual drive assembly 590 (FIG. 12). An example of a manual drive system is described in greater detail in U.S. patent application Ser. No. 11/985,418, filed Nov. 15, 2007, entitled ROLLER SHADE CLUTCH ASSEMBLY, the entire disclosure of which is hereby incorporated by reference. The electronic drive unit 490 of the motor drive system and the manual drive assembly 590 of the manual drive system will be described in greater detail below.

Figure 2:
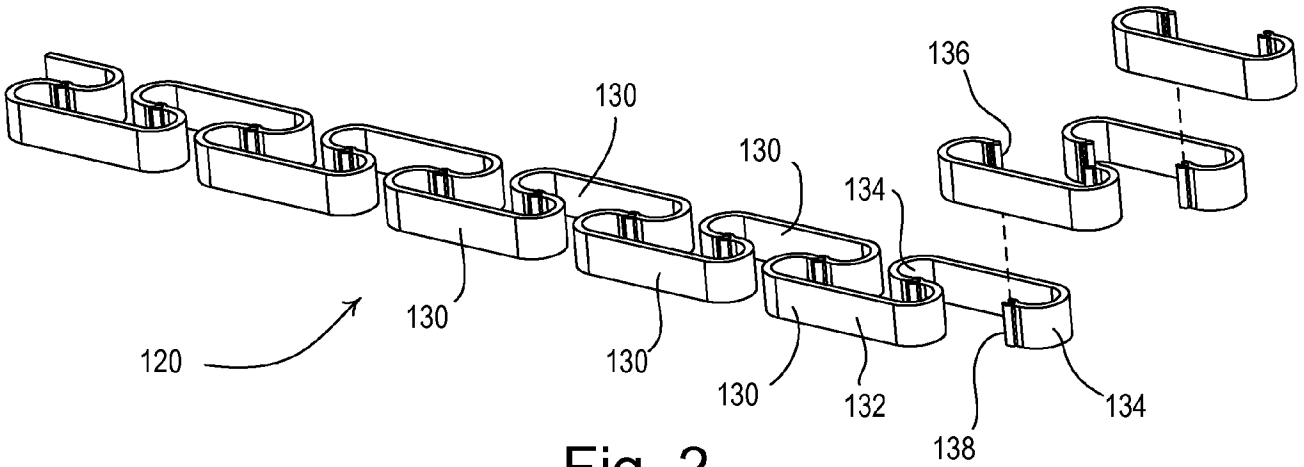
FIG. 2 is a perspective view of a pleating hem bar of the pleated shade system of FIG. 1.
Figure 3:
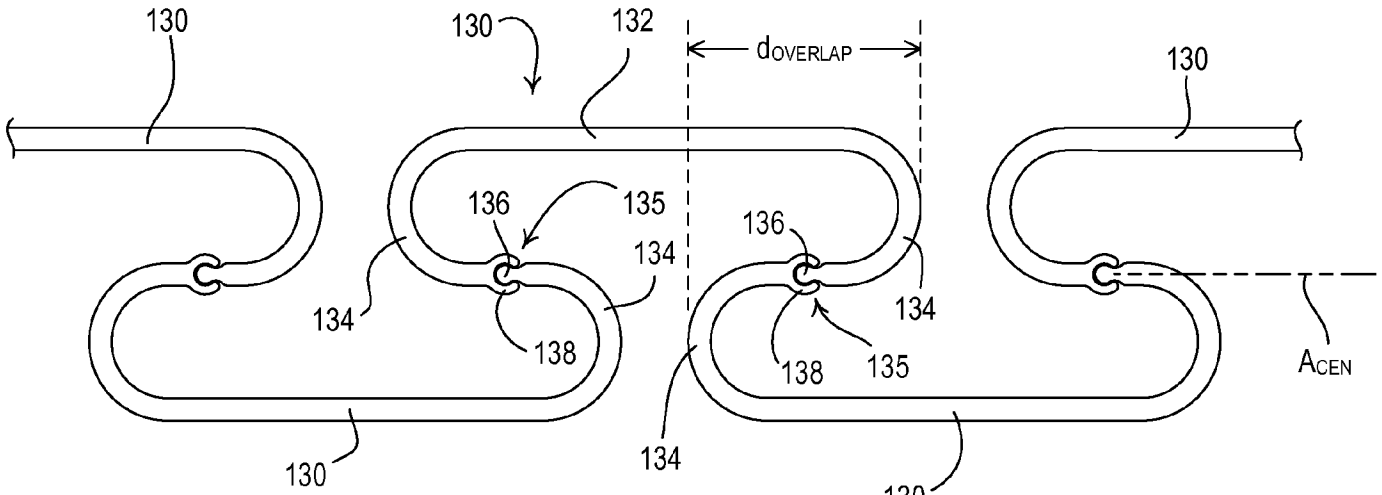
FIG. 3 is a partial top view of the pleating hem bar of FIG. 2.

Referring back to FIG. 1, the hem bar pocket 116 is adapted to hold a weighting element, e.g., a pleating hem bar 120 (FIG. 2) that allows the shade fabric 110 to hang from the roller tube 112. FIG. 2 is a perspective view and FIG. 3 is a partial top view of the pleating hem bar 120 according to the first embodiment of the present invention. The pleating hem bar 120 has a non-linear shape (e.g., a serpentine shape) and operates to pleat the shade fabric 110, such that the shade fabric hangs with a plurality of pleats 122 as shown in FIG. 1. The shade fabric 110 may be sewn near the top edge that connects to the roller tube 112 (i.e., the first fabric end opposite the bottom edge 118), such that the shade fabric wraps around the roller tube in a plurality of folds 124 (i.e., when the roller tube is rotated in the first angular direction to move the bottom edge 118 in the upward direction).

Because the shade fabric 110 is folded as the shade fabric is wrapped around the roller tube 112 and the pleating hem bar 120 causes the fabric to hang in the pleats 122, the total width of the unwrapped shade fabric is substantially greater than the length L of the roller tube. For example, the total width of the unwrapped shade fabric 110 may be twice as long as the length L of the roller tube 112. The width of the unwrapped shade fabric 110 is defined as the distance between the opposites sides of the shade fabric (i.e., measured in the same direction as the length L of the roller tube 112 shown in FIG. 1) when the shade fabric is pulled taunt.

Figure 4A:
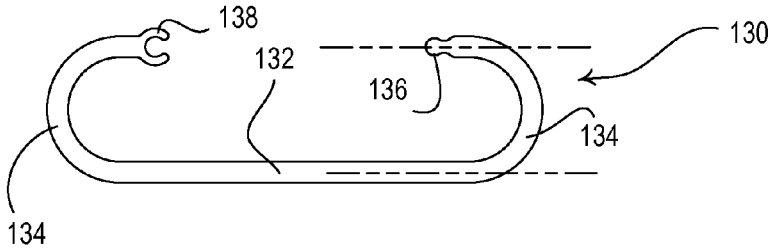
FIG. 4A is a top view of one of a plurality of hem bar portions of the pleating hem bar of FIG. 2.
Figure 4B:
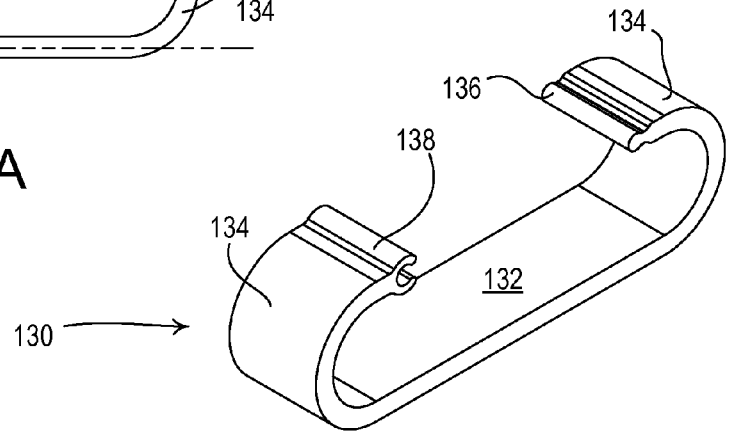
FIG. 4B is a perspective view of hem bar portion of FIG. 4A.
Figure 5A:
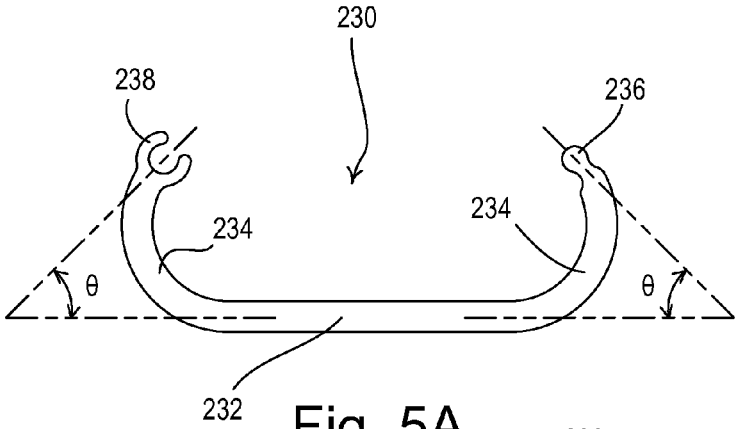
FIG. 5A is a top view of a hem bar portion of a pleating hem bar according to a second embodiment of the present invention.
Figure 5B:
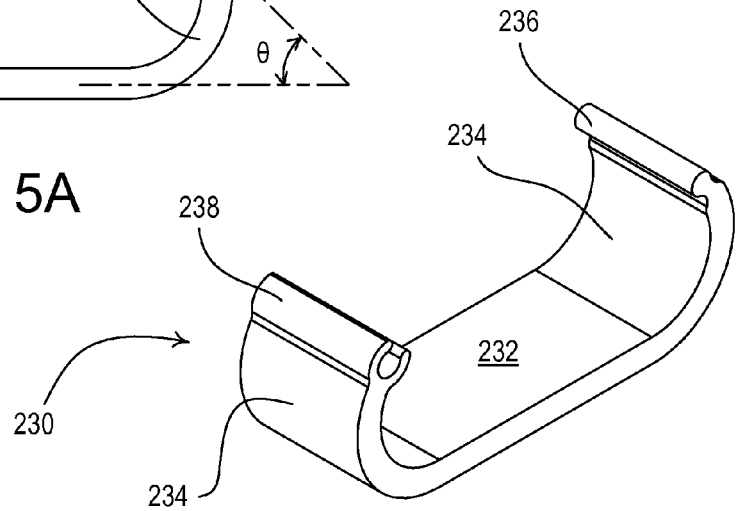
FIG. 5B is a perspective view the hem bar portion of FIG. 5A.

The pleating hem bar 120 is constructed from a plurality of C-shaped hem bar sections 130. FIG. 4A is a top view and FIG. 4B is a perspective view of one of the hem bar sections 130 according to the first embodiment of the present invention. Each hem bar section 130 comprises an elongated portion 132 surrounded by two curved (e.g., semi-circular) portions 134. The hem bar sections 130 are coupled together via interlocking structures 135 (as shown in FIG. 3). Specifically, each hem bar section 130 comprises an interior interlocking portion 136 at a first end of the hem bar section (i.e., at the end of one of the curved portions 134) and an exterior interlocking portion 138 at a second end of the hem bar section (i.e., at the end of the opposing curved portion). The interior interlocking portion 136 of one hem bar section 130 is received within the exterior FIG. 5A is a top view and FIG. 5B is a perspective view of a hem bar section 230 according to a second embodiment of the present invention. The hem bar section 230 comprises an elongated portion 232 surrounded by two curved portions 234, at the ends of which are either an interior interlocking portion 236 or an exterior interlocking portion 238. The interior and exterior interlocking potions 236, 238 extend in a plane that is oriented at an angle θ (e.g., approximately 45°) with respect to a plane of the elongated portion 232 (as shown in FIG. 5A), such that the hem bar sections 230 form a serpentine shape when connected together. Accordingly, there is not as much overlap of the shade fabric 110 when the hem bar sections 230 of the second embodiment are used (as compared to the hem bar sections 130 of the first embodiment).

Figure 6:
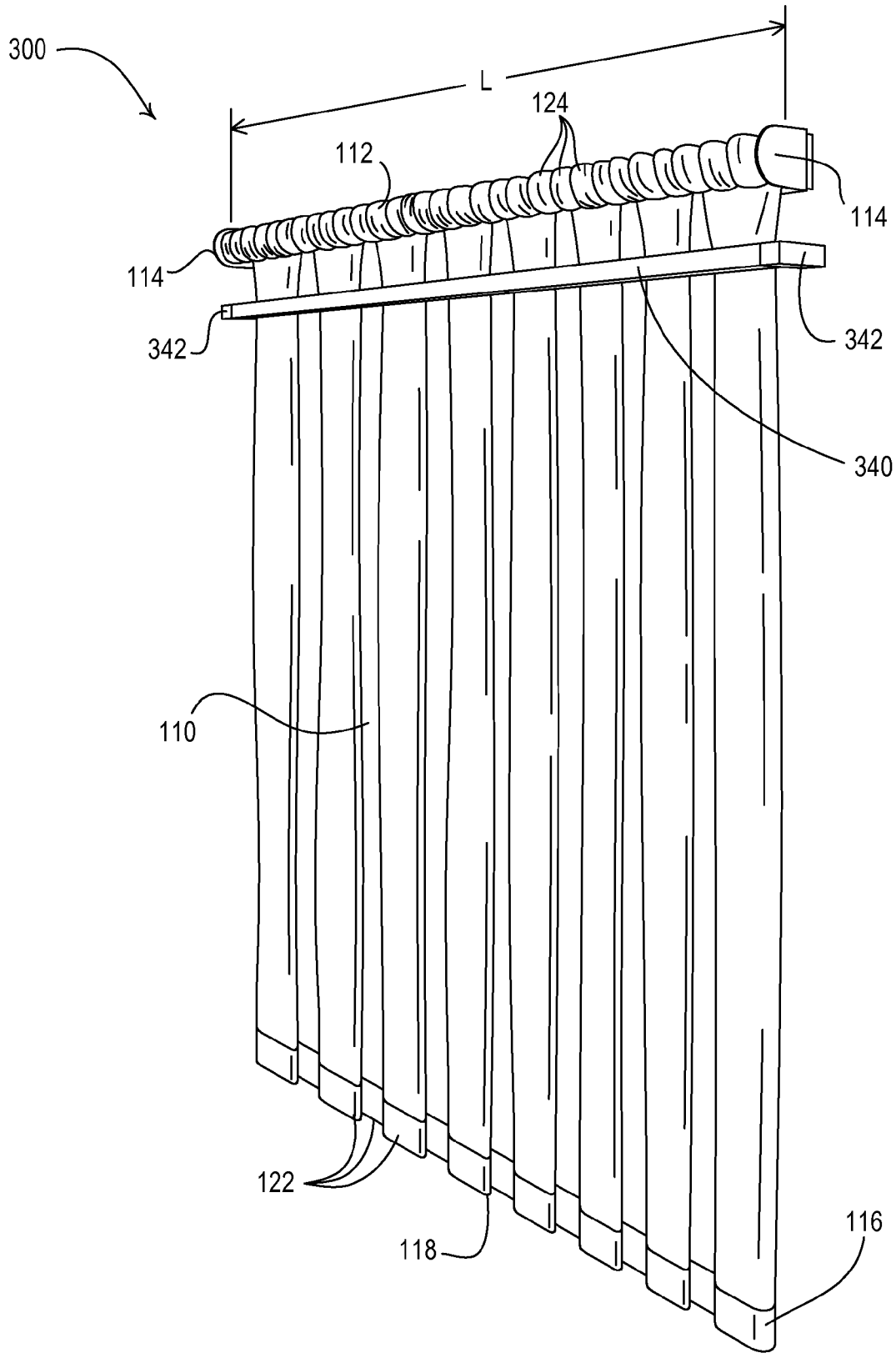
FIG. 6 is a perspective view of a pleated roller shade system having a pleated shade fabric and a pleating assembly according to a third embodiment of the present invention.

FIG. 6 is a perspective view of a pleated roller shade system 300 comprising an elongated pleating assembly 340 (i.e., a "pleating bar") according to a third embodiment of the present invention. The pleating assembly 340 is adapted to be mounted to the wall below the roller tube 112 via mounting ends 342. The shade fabric 110 slides through the pleating assembly 340 as the roller tube 110 rotates to further assist in causing the shade fabric to form the pleats 122. The pleating assembly 340 also operates to fold the shade fabric 110 into the plurality of folds 124 as the shade fabric is wound around the roller tube 112 (i.e., when the roller tube is rotated in the first angular direction to move the bottom edge 119 in the upward direction). Alternatively, the roller tube 112 and the pleating assembly 340 could be mounted to a horizontal surface (e.g., a ceiling), or between the sides of an opening (e.g., a window).

Figure 7:
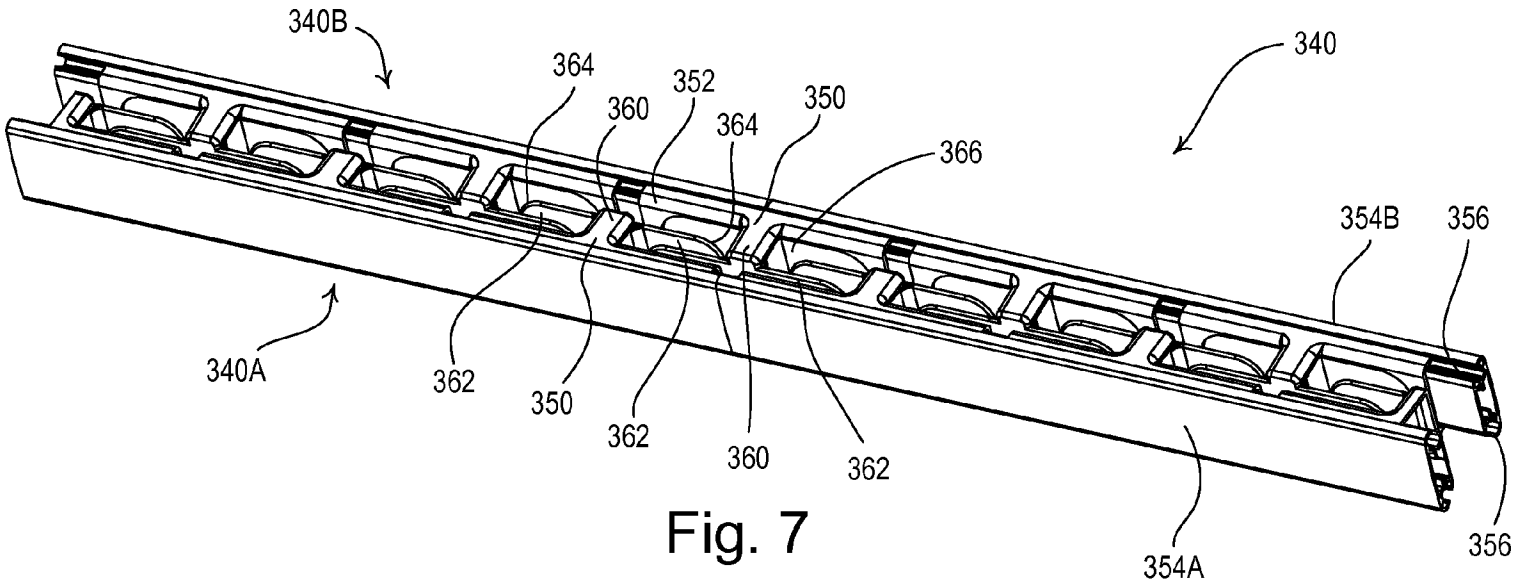
FIG. 7 is a perspective view of a portion of the pleating assembly of the pleated roller shade system of FIG. 6.
Figure 8:
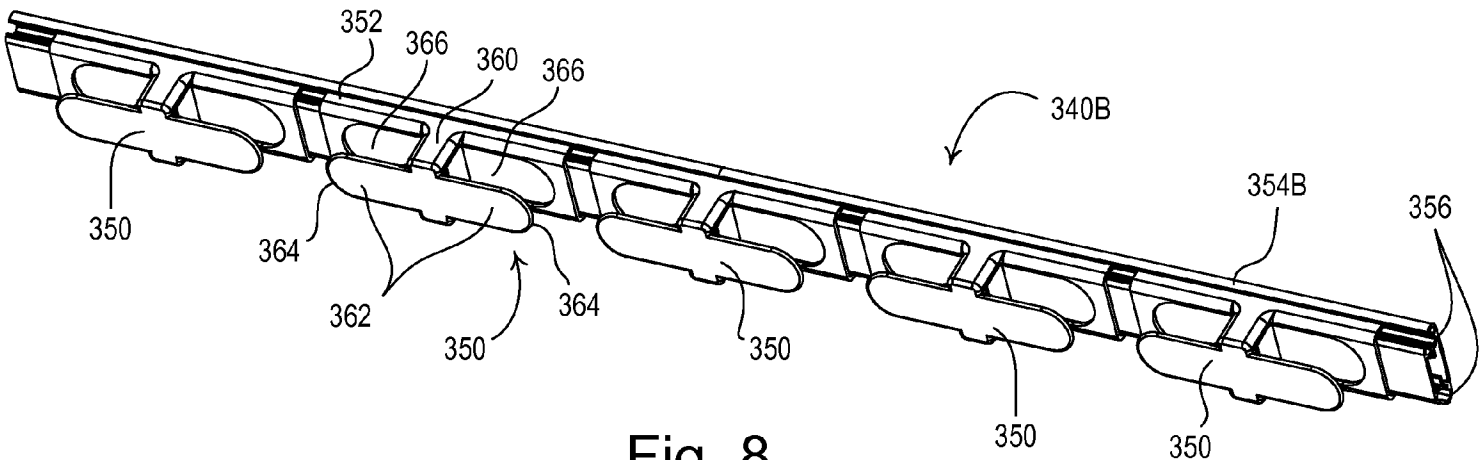
FIG. 8 is a perspective view of a portion of one of two pleating structures of the pleating assembly of FIG. 7.
Figure 9:
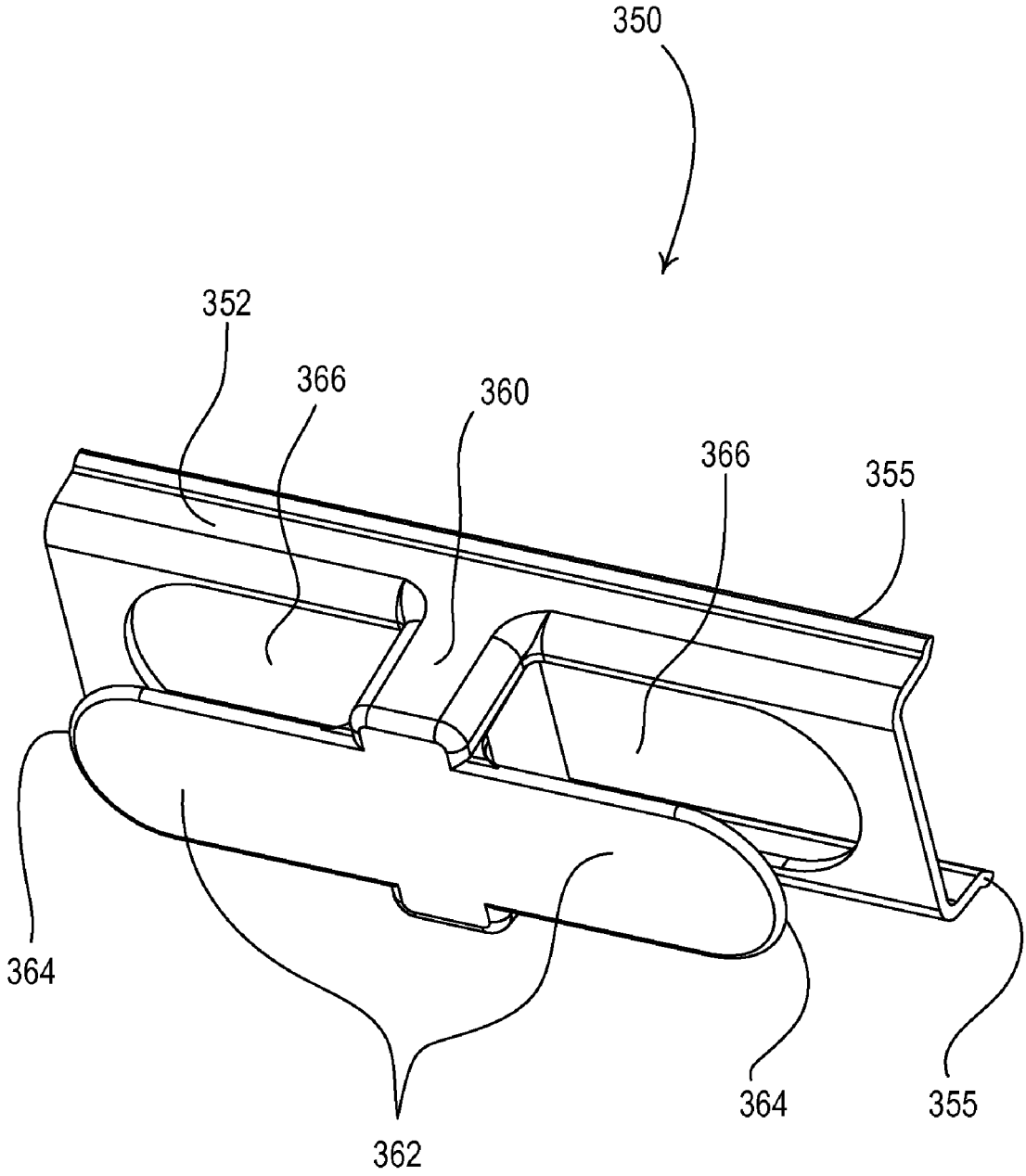
FIG. 9 is a perspective view of one of a plurality of pleating elements of the pleating assembly of FIG. 7.

FIG. 7 is a perspective view of a portion of the pleating assembly 340, which comprises two parallel pleating structures 340A, 340B. FIG. 8 is a perspective view of a portion of one of the pleating structures 340B of the pleating assembly 340. FIG. 9 is a perspective view of one of a plurality of pleating elements 350 of the pleating assembly 340. Each pleating element 350 comprises a base 352 for mounting to one of two support bars 354A, 354B. The support bars 354A, 354B are oriented parallel to each other along the length of the pleating assembly 340 (i.e., along a longitudinal axis of the pleating assembly). Each of the pleating elements 350 has flanges 355 (FIG. 9) that are received within slots 336 of the supports bars 354A, 354B, such that the pleating elements 350 may be slid across the length of the support bars. The pleating elements 350 are spaced apart at intervals from each other along the length of the supports bars 354A, 354B. The pleating elements 350 also have projections 360 that define, for example, "T-shaped" structures. Each projection 360 has two extensions 362 that are oriented parallel to the base 352 (i.e., parallel to the support bars 354A, 354B) and have rounded edges 364. A gap 366 is formed between the extensions 362 of the projections 360 and the base 352 of the pleating elements 350.

Figure 10:
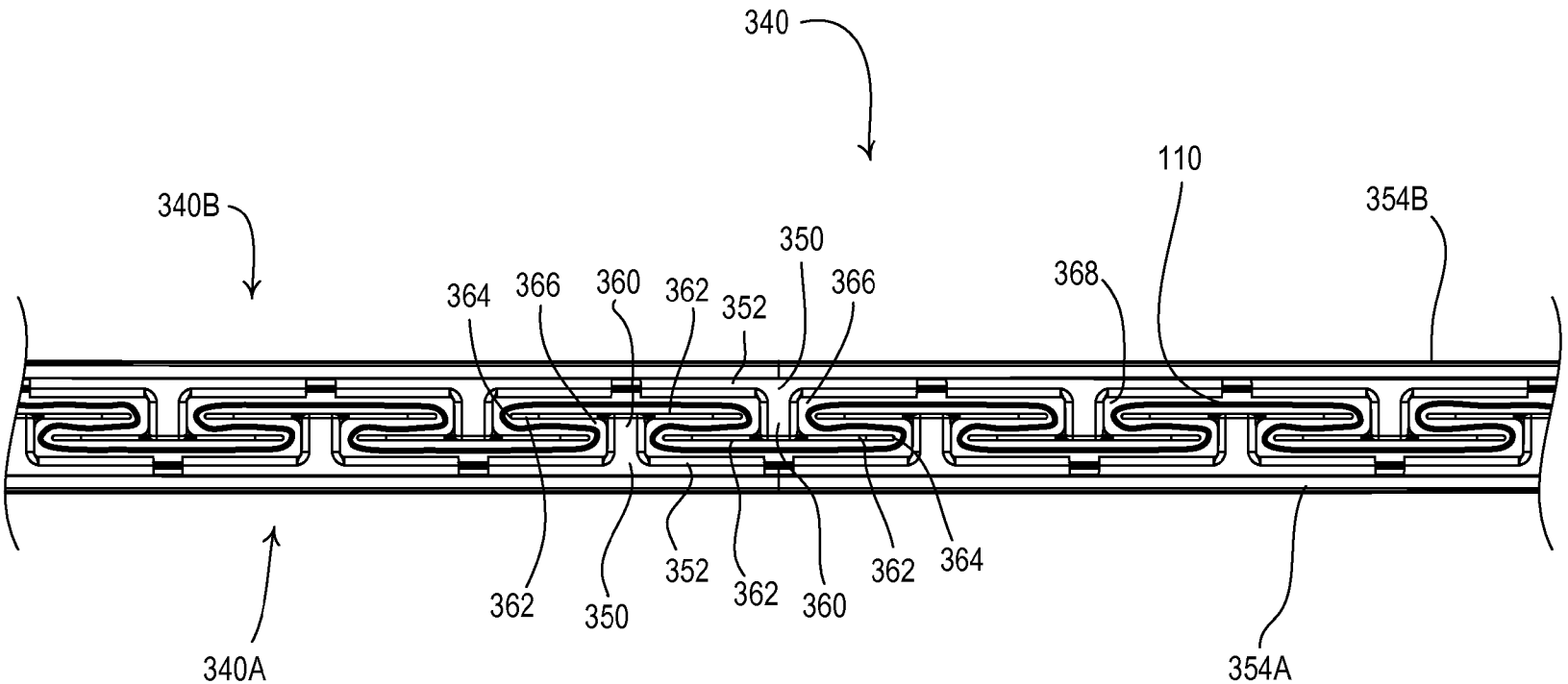
FIG. 10 is a partial top view of the pleating assembly of FIG. 7 showing the shade fabric received through the pleating assembly.

FIG. 10 is a partial top view of the pleating assembly 340 showing the shade fabric 110 received through the pleating assembly. The two parallel pleating structures 340A, 340B are mounted such that the projections 360 of the pleating elements 350 connected to the first and second support bars 354A, 354B extend towards the second and first support bars, respectively. The extensions 362 of the pleating elements 350 connected to the first support bar 354A are received within the gaps 366 of the pleating elements 350 connected to the second support bar 354B (and vice versa). Accordingly, a fabric-receiving opening 368 defining a non-linear path (e.g., a serpentine path) is provided between the two parallel pleating structures 340A, 340B. The shade fabric 110 is received through the fabric-receiving opening 368, such that the shade fabric assumes a non-linear, serpentine shape when viewed from above as shown in FIG. 10.

Because the projections 360 of the pleating elements 350 have T-shaped structures and the extensions 362 are provided in the gaps 366 of the pleating elements, there is overlap of the shade fabric 110 as the shade fabric wraps onto the roller tube 112 allowing the pleating assembly 340 to fold the shade fabric 110 as the shade fabric wraps around the roller tube (i.e., into folds 124). Therefore, the thickness of shade fabric wrapped around the roller tube 112 is minimized and bunching of the shade fabric is avoided. Since the pleated shade fabric 110 is neatly wrapped around the roller tube 112 when rolled up, the shade fabric is stored out-of-sight from a user and no additional space is need for storage of the fabric (e.g., at sides of a window that the roller shade system 100 is covering). The rounded edges 364 of the extensions 362 of the pleating elements 350 guide the shade fabric 110 through the fabric-receiving opening 368 without ripping or tearing the shade fabric.

Figure 11:
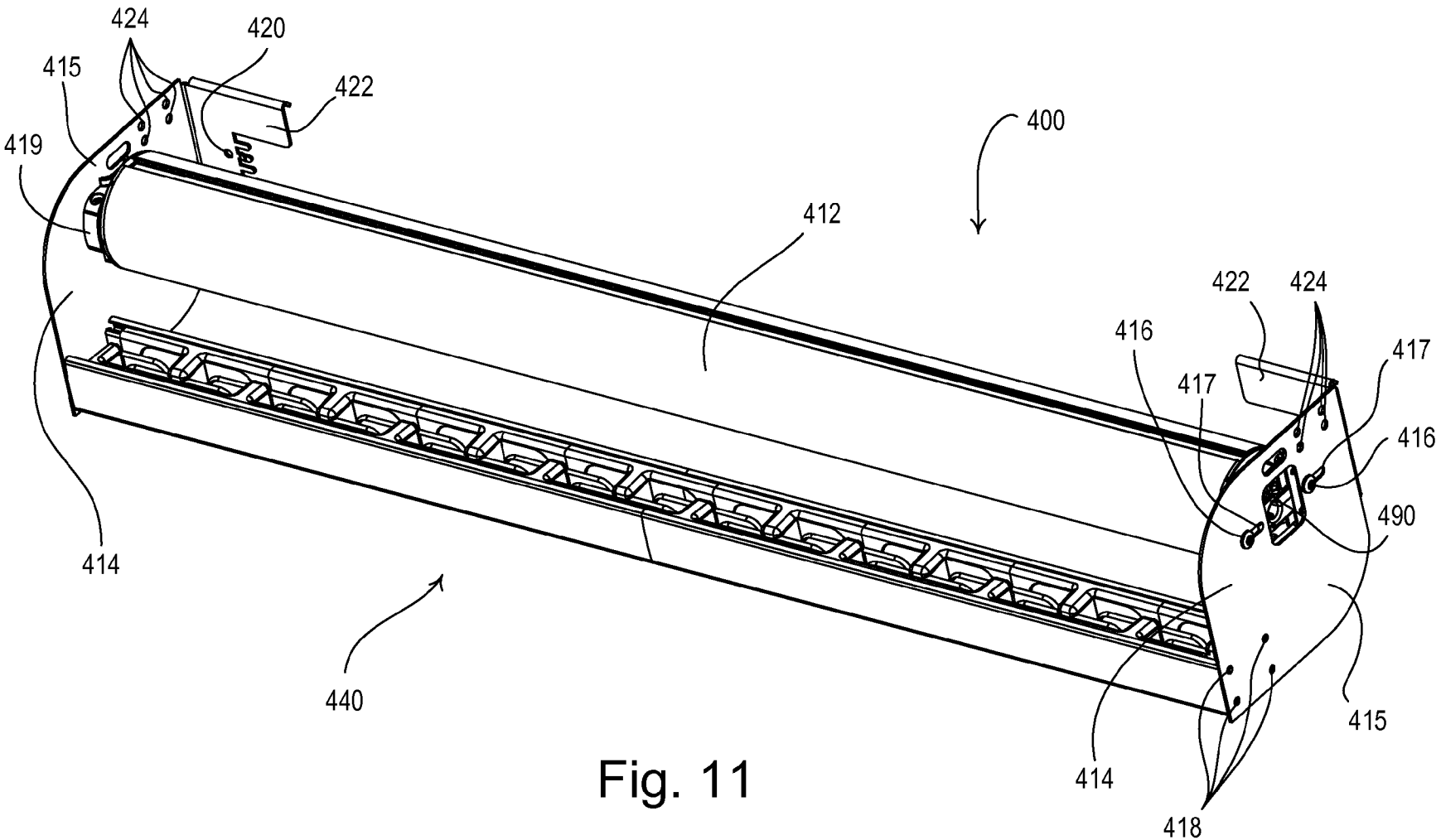
FIG. 11 is a perspective view of a pleated roller shade system having a pleating assembly and a motor drive system according to a fourth embodiment of the present invention.
Figure 12:
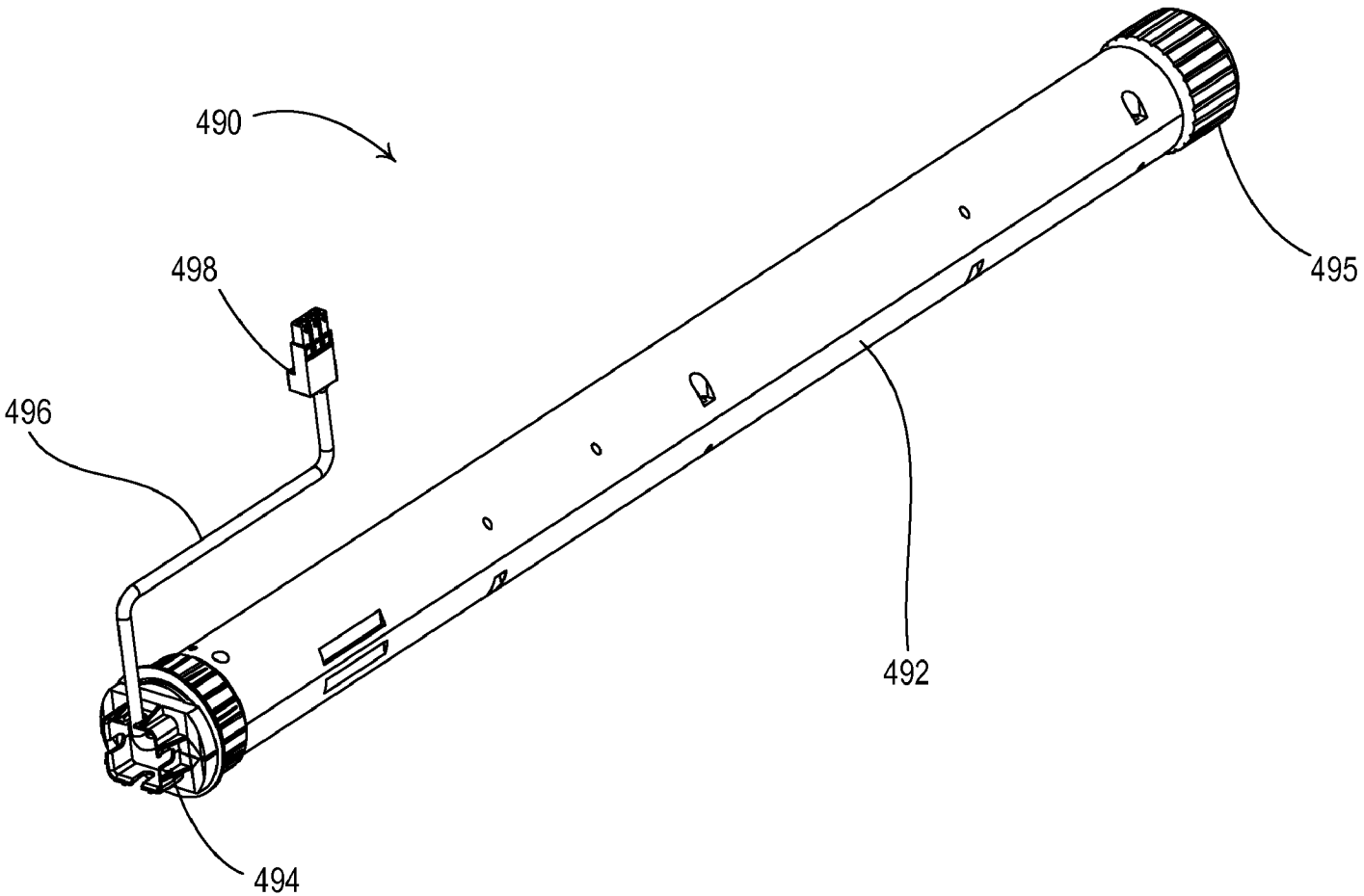
FIG. 12 is a perspective view of an electronic drive unit of the motor drive system of the pleated roller shade system of FIG. 11.

FIG. 11 is a perspective view of a pleated roller shade system 400 having a motor drive system according to a fourth embodiment of the present invention. The pleated roller shade system 400 comprises a roller tube 412, a pleating assembly 440, and two mounting brackets 410 to which both the roller tube and the pleating assembly are mounted. The roller tube 412 is rotatably mounted to two side portions 415 of the mounting brackets 414 via screws 416 received through attachment openings 417. The electronic drive unit 490 of the motor drive system is housed inside a first end of the roller tube 412. The pleated roller shade system 400 also comprises an idler assembly 419, which is located adjacent a second end of the roller tube 412 opposite the electronic drive unit 490, and provides rotatable support for the roller tube at the second end of the roller tube. The pleating assembly 440 is connected to the side portions 415 via attachment openings 418. The pleated roller shade system 400 may be mounted to a vertically-oriented wall via mounting holes 420 in rear portions 422 of the mounting brackets 414 or between the sides of an opening via mounting holes 424 in the side portions 415.

FIG. 12 is a perspective view of the electronic drive unit 490 of the pleated roller shade system 400 of the fourth embodiment of the present invention. The electronic drive unit 490 comprises a motor (not shown) and a motor drive circuit (not shown) housed within an enclosure 492. The electronic drive unit 490 comprises an attachment end 494, which is fixedly attached to one of the side portions 415 of the mounting brackets 414 (i.e., via the screws 416 received through the attachment openings 417). The electronic drive unit 490 also comprises a coupler end 495, which is operable to rotate with respect to the enclosure 492 as the drive shaft of the motor rotates, and is coupled to the roller tube 412 to provide for rotation of the roller tube. The electronic drive unit 490 further comprises an electrical cable 496 having an electrical connector 498, which allows the electronic drive unit to be electrically coupled to a power source for powering the motor drive circuit and the motor. The electrical connector 498 also allows the electronic drive unit 490 to be electrically coupled to a wired digital communication link, such that the electronic drive unit may be operable to rotate the roller tube 412 in response to digital messages received via the communication link, for example, from a control device (not shown), such as, a keypad or a central controller. Alternatively, the communication link may comprise a wireless communication link, such as a radio-frequency (RF) or an infrared (IR) communication link. An example of an electronic drive unit operable to communication via an RF communication link is described in greater detail in commonly-assigned, co-pending U.S. patent application Ser. No. 11/751,901, filed May 22, 2007, entitled RADIO-FREQUENCY CONTROLLED MOTORIZED ROLLER SHADE, the entire disclosure of which is hereby incorporated by reference.

Figure 13:
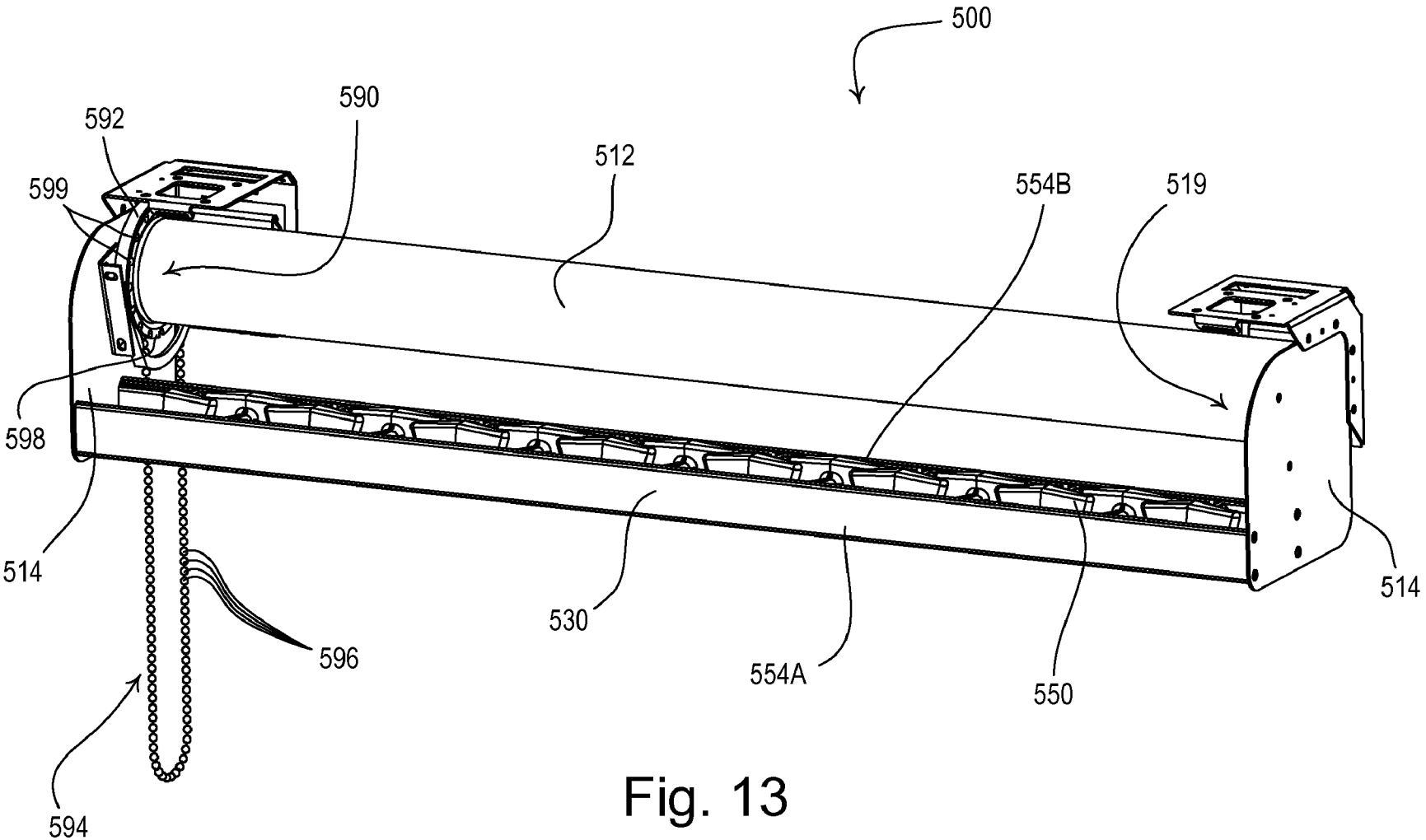
FIG. 13 is a perspective view of a pleated roller shade system having a pleating assembly and a manual drive system according to a fifth embodiment of the present invention.

FIG. 13 is a perspective view of a pleated roller shade system 500 having a manual drive system according to a fifth embodiment of the present invention. The pleated roller shade system 500 comprises a roller tube 512, a pleating assembly 540, and two mounting brackets 514 at opposite ends of the roller tube for supporting the roller tube and the pleating assembly from a fixed support surface, such as a wall or ceiling. The manual drive assembly 590 comprises a clutch mechanism 592, which is located adjacent one end of the roller tube 512 and allows for rotating the roller tube in both directions. The pleated roller shade system 500 includes an idler assembly 519 located adjacent a second end of the roller tube 512 opposite the clutch mechanism 592. The idler assembly 519 provides rotatable support for the roller tube 512 at the second end of the roller tube.

The manual shade assembly 590 further comprises an elongated drive chain 594 having spherical beads 596 spaced along the length of the drive chain. The drive chain 594 is received by the clutch mechanism 592 and is graspable by a user such that a pulling force can be applied to the drive chain for drivingly rotating the roller tube 512 to either wind or unwind the shade fabric depending on which direction the roller tube is rotated. The beads 596 of the drive chain 594 are received by notches 599 of a drive chain sprocket 598 of the clutch mechanism 592. The drive chain sprocket 598 is connected to the roller tube 512 such that the pulling force on the drive chain results in rotation of the sprocket and the roller tube. An example of the manual drive assembly 590 is described in greater detail in U.S. patent application Ser. No. 11/985,418.

Figure 14:
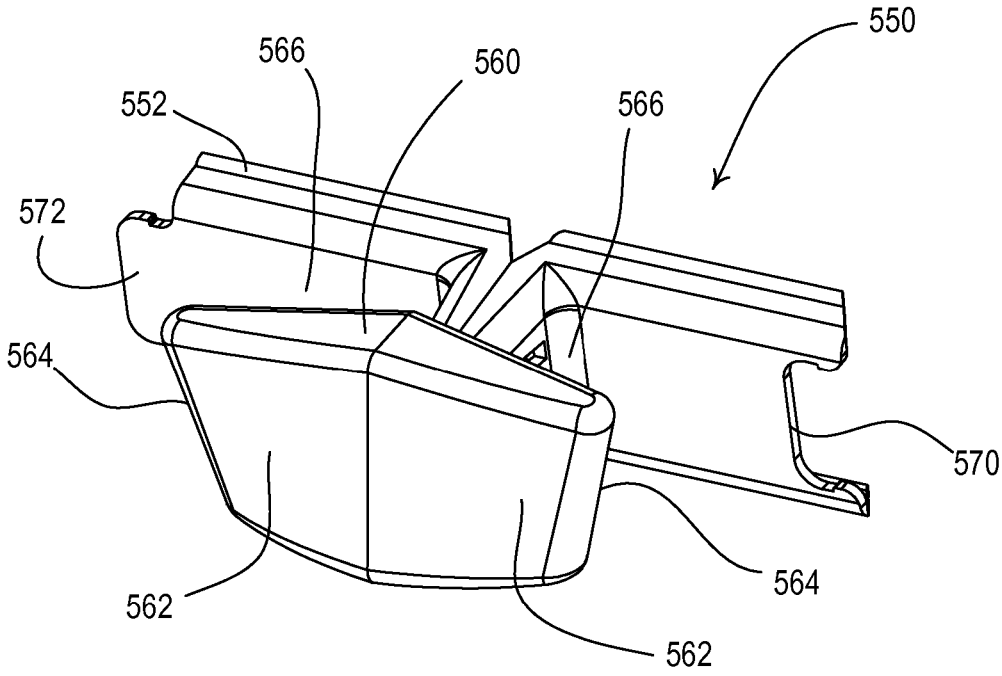
FIG. 14 is an enlarged perspective view of one of a plurality of pleating elements of the pleating assembly of FIG. 13.
Figure 15:
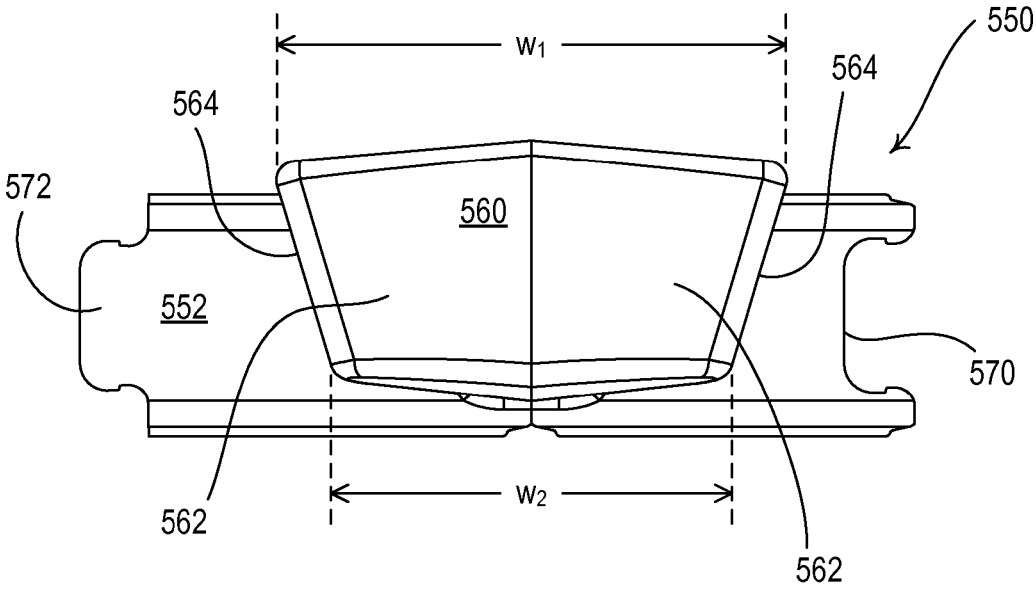
FIG. 15 is a front view of the pleating element of FIG. 14.
Figure 16:
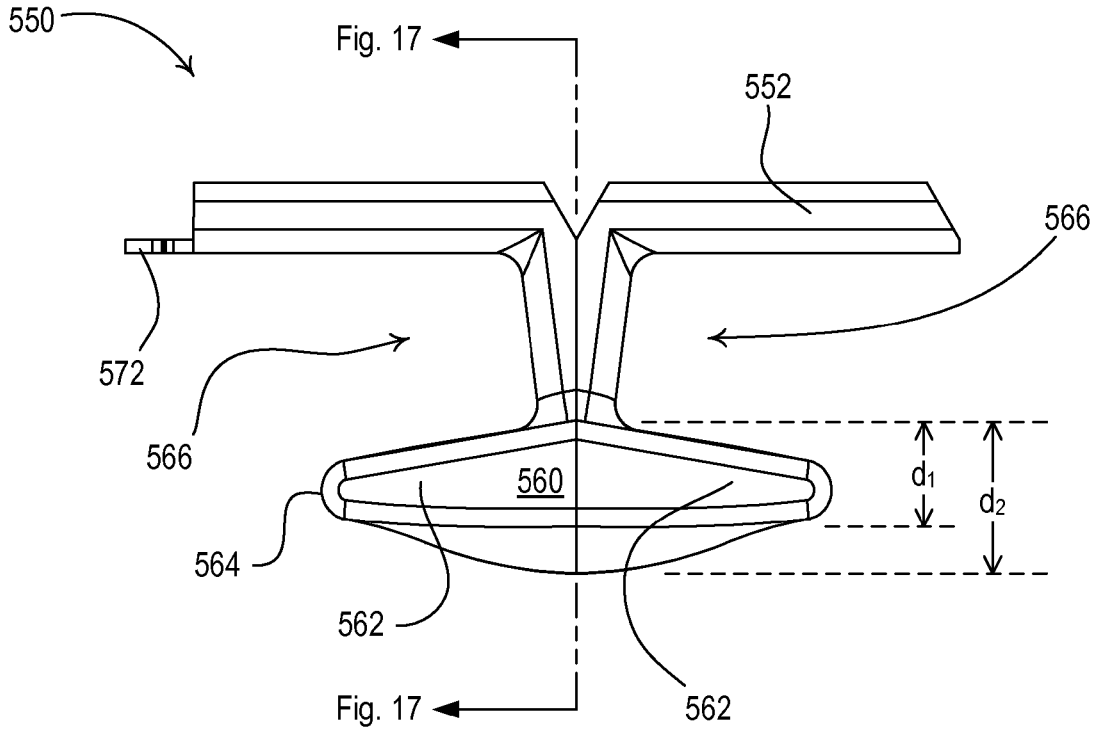
FIG. 16 is a top view of the pleating element of FIG. 14.
Figure 17:
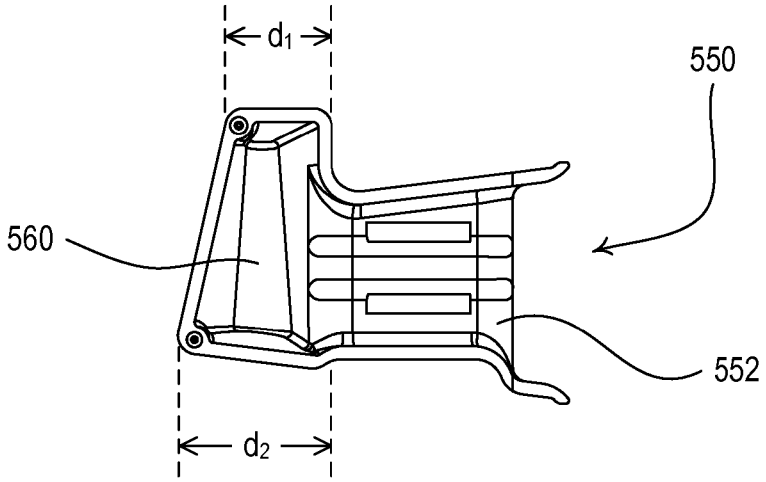
FIG. 17 is a right-side cross-sectional view of the pleating element of FIG. 14 taken through the center of the pleating element.

The pleating assembly 540 comprises a plurality of pleating elements 550 attached to two support bars 554A, 554B. FIG. 14 is an enlarged perspective view, FIG. 15 is a front view, and FIG. 16 is a top view of one of the pleating elements 550 of the pleating assembly 540. FIG. 17 is a right-side cross-sectional view of one of the pleating elements 550 taken through the center of the pleating element (as shown in FIG. 16). Each pleating element 550 comprises a base 552 for mounting to one of the two support bars 554A, 554B. The pleating elements 550 have projections 560 that form funnel-shaped structures. Particularly, the pleating elements 550 form truncated tetrahedron shaped structures as shown in FIGS. 14-17. Each projection 560 has a first width $w_1$ at the top and a second width $w_2$ at the bottom as shown in FIG. 15. In addition, each projection 560 has a first depth $d_1$ at the top and a second depth $d_2$ at the bottom as shown in FIGS. 16 and 17. Each projection 560 has two extensions 562 that are oriented parallel to the base 552 and thus parallel to the support bars 554A, 554B, such that gaps 566 are formed between the extensions 562 of the projection 560 and the base 552 of the pleating element 550. The projection 560 of each pleating element 550 has smooth edges 564 at the ends of the extensions 562. The pleating elements 550 each comprise an attachment opening 570 and a corresponding attachment tab 572 adapted to be received within the attachment opening of an adjacent pleating element for mechanically coupling the two pleating elements together.

Similar to the support bars 354A, 354B of the pleating assembly 340 of the third embodiment, the support bars 554A, 554B of the fifth embodiment are oriented parallel to each other, such that a fabric-receiving opening defining a non-linear path (i.e., a serpentine path) is provided between the pleating elements 550 of the pleating assembly 540. The shade fabric of the pleated roller shade system 500 is received through the fabric-receiving opening of the pleating assembly 540, such that the shade fabric assumes a non-linear, serpentine shape when viewed from above. The second depth $d_2$ (e.g., approximately 0.80 inches) is greater than the first depth $d_1$ (e.g., approximately 0.55 inches) of each projection 560, such that the funnel-shaped structures of the projections form deep pleats as the shade fabric hangs below the pleating assembly 540. In addition, the first width $w_1$ (e.g., approximately 2.66 inches) is greater than the second width $w_2$ (e.g., approximately 2.10 inches) of each projection 560 to assist in folding the shade fabric as the shade fabric wraps around the roller tube 512.

Figure 18:
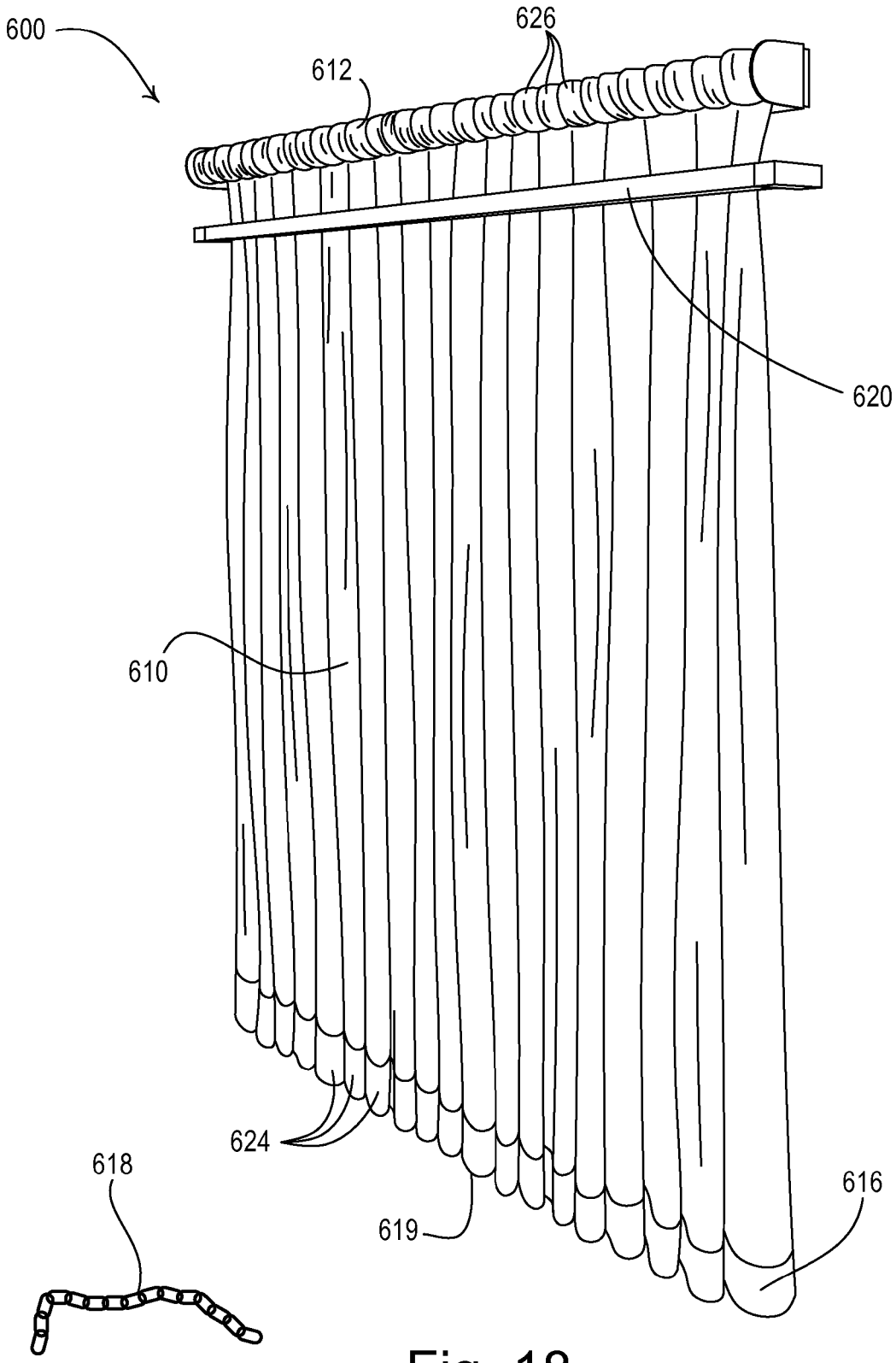
FIG. 18 is a perspective view of a pleated roller shade system having a pleated shade fabric and a pleating assembly according to a sixth embodiment of the present invention.

FIG. 18 is a perspective view of a pleated roller shade system 600 having a pleated shade fabric 612 according to a sixth embodiment of the present invention. The pleated roller shade system 600 of the sixth embodiment comprises only a pleating assembly 630 and does not comprise a pleating hem bar. The shade fabric 610 comprises a hem bar pocket 616 at a bottom edge 619 of the shade fabric. The hem bar pocket 616 is adapted to hold a weighting element, e.g., a flexible chain 618, such that the shade fabric 610 hangs from the roller tube 612. The shade fabric 610 slides through the pleating assembly 630 as a roller tube 612 rotates resulting in the shade fabric hanging freely with a plurality of pleats 624.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A roller shade system comprising:

a rotatably-mounted roller tube;

a flexible shade fabric windingly received around the roller tube, the shade fabric having a first fabric end connected to the roller tube and a second fabric end opposite the first fabric end, the second fabric end adapted to move in an upwards direction and in a downwards direction as the roller tube is rotated in respective first and second directions, the shade fabric comprising a weighting element at the second fabric end, such that the shade fabric hangs from the roller tube;

a drive system coupled to the roller tube for controlling the rotation of the roller tube; and an elongated pleating assembly defining a fabric-receiving opening and mounted such that the shade fabric is received through the fabric-receiving opening, the pleating assembly adapted to fold the shade fabric, such that the shade fabric is wrapped around the roller tube in folds as the drive system rotates the roller tube in the first direction to move the second fabric end of the shade fabric in the upwards direction.

2. The roller shade system of claim 1, wherein the drive system is located adjacent a first end of the roller tube.

3. The roller shade system of claim 2, wherein the drive system comprises a motor drive system.

4. The roller shade system of claim 3, wherein the motor drive system comprises an electronic drive unit located inside the roller tube and adjacent the first end of the roller tube, the electronic drive unit rotatably coupled to the roller tube and operable to be electrically coupled to a communication link, such that the electronic drive unit is operable to rotate the roller tube in response to a digital command received via the communication link.

5. The roller shade system of claim 2, wherein the drive system comprises a manual drive system.

6. The roller shade system of claim 5, wherein the manual drive system comprises a clutch mechanism having a drive chain, the clutch mechanism coupled to the roller tube such that a pulling force on the drive chain results in rotation the roller tube.

7. The roller shade system of claim 2, further comprising:

a pair of mounting brackets, the drive system fixed attached to one of the mounting brackets and rotatably coupled to the roller tube, such that the roller tube is rotatably mounted between the pair of mounting brackets, the pleating assembly mounted between the pair of mounting brackets such that the shade fabric hangs from the roller tube through the fabric-receiving opening to the second fabric end.

8. The roller shade system of claim 1, wherein the pleating assembly is mounted parallel to and below the roller tube, such that the shade fabric hangs from the roller tube through the fabric-receiving opening to the second fabric end, the pleating assembly comprising first and second support bars oriented parallel to each other along a longitudinal axis of the pleating assembly, the pleating assembly further comprising a plurality of pleating elements for causing the shade fabric to assume a non-linear shape, the pleating elements coupled to the supports bars and spaced at intervals from each other, the pleating elements coupled to the first and second support bars extending towards the second and first support bars, respectively, such that the shade fabric assumes the non-linear shape.

9. The roller shade system of claim 8, wherein the pleating elements each comprise a projection defining a funnel-shaped structure, the support bars mounted with respect to each other such that the fabric-receiving opening is formed between the pleating elements connected to the support bars, and the fabric-receiving opening forms a serpentine path.

10. The roller shade system of claim 9, wherein each projection has a first depth at the top and a second depth at the bottom, the first and second depths measured perpendicularly to the longitudinal axis of the pleating assembly, the second depth greater than the first depth to assist in forming pleats in the shade fabric as the shade fabric hangs below the pleating assembly.

11. The roller shade system of claim 10, wherein each projection has a first width at the top and a second width at the bottom, the first and second widths measured along the longitudinal axis of the pleating assembly, the first width greater than the second width to assist in forming folds in the shade fabric as the shade fabric is wrapped around the roller tube.

12. The roller shade system of claim 8, wherein the pleating elements each comprise a projection defining a T-shaped structure, the support bars mounted with respect to each other such that the fabric-receiving opening is formed between the pleating elements connected to the support bars, and the fabric-receiving opening forms a serpentine path.

13. The roller shade system of claim 1, wherein the shade fabric comprises a hem bar pocket at the second fabric end for holding the weighting element, the weighting element comprises one of a chain and a pleating hem bar characterized by a non-linear shape for causing the shade fabric to hang with a plurality of pleats.

14. A roller shade system comprising:

a rotatably-mounted roller tube;

a drive system coupled to the roller tube for controlling the rotation of the roller tube;

a flexible shade fabric windingly received around the roller tube, the shade fabric having a first fabric end connected to the roller tube and a second fabric end opposite the first fabric end, the shade fabric comprising a hem bar pocket at the second fabric end, the second fabric end adapted to move in an upward direction and in a downwards direction as the drive system rotates the roller tube in respective first and second directions; and a pleating hem bar contained within the hem bar pocket, the pleating hem bar characterized by a non-linear shape for causing the shade fabric to hang with a plurality of pleats.

15. The roller shade system of claim 14, wherein the drive system is located adjacent a first end of the roller tube.

16. The roller shade system of claim 15, wherein the drive system comprises a motor drive system.

17. The roller shade system of claim 16, wherein the motor drive system comprises an electronic drive unit located inside the roller tube and adjacent the first end of the roller tube, the electronic drive unit rotatably coupled to the roller tube and operable to be electrically coupled to a communication link, such that the electronic drive unit is operable to rotate the roller tube in response to a digital command receive via the communication link.

18. The roller shade system of claim 15, wherein the drive system comprises a manual drive system.

19. The roller shade system of claim 18, wherein the manual drive system comprises a clutch mechanism having a drive chain, the clutch mechanism coupled to the roller tube such that a pulling force on the drive chain results in rotation the roller tube.

20. The roller shade system of claim 15, further comprising:

a pair of mounting brackets, the drive system fixed attached to one of the mounting brackets and rotatably coupled to the roller tube, such that the roller tube is rotatably mounted between the pair of mounting brackets, the pleating bar mounted between the pair of mounting brackets such that the shade fabric hangs from the roller tube through the fabric-receiving opening to the second fabric end.

21. The roller shade system of claim 14, wherein the pleating hem bar comprises a plurality of C-shaped hem bar sections having first and second ends, the first end of each hem bar section adapted to be coupled to the second end of another adjacent hem bar section.

22. The roller shade system of claim 21, wherein each hem bar section comprises an elongated portion surrounded by two curved portions, the hem bar sections coupled together via interlocking structures, the first end of each hem bar section comprising an interior interlocking portion and the second end of each hem bar section comprising an exterior interlocking portion, each hem bar section able to pivot about an axis defined by the respective interior interlocking portion, such that the hem bar sections are pivotably attached to each other.

23. The roller shade system of claim 21, wherein each hem bar section comprises an elongated portion surrounded by two semi-circular portions, such that the pleating hem bar has a serpentine shape.

24. A roller shade system comprising:

a rotatably-mounted roller tube;

a flexible shade fabric windingly received around the roller tube, the shade fabric having a first fabric end connected to the roller tube and a second fabric end opposite the first fabric end, the shade fabric comprising a hem bar pocket at the second fabric end, the second fabric end adapted to move in an upward direction and in a downwards direction as the roller tube is rotated in respective first and second directions;

a pleating hem bar contained within the hem bar pocket, the pleating hem bar characterized by a non-linear shape for causing the shade fabric to hang with a plurality of pleats;

a drive system located adjacent one end of the roller tube and coupled to the roller tube for controlling the rotation of the roller tube; and an elongated pleating assembly defining a fabric-receiving opening and mounted parallel to the roller tube such that the shade fabric is received through the fabric-receiving opening, the pleating assembly adapted to fold the shade fabric, such that the shade fabric is wrapped around the roller tube in folds as the drive system rotates the roller tube in the first direction to move the second fabric end of the shade fabric in the upward direction.

25. The roller shade system of claim 24, wherein the pleating assembly is mounted below the roller tube, such that the shade fabric hangs from the roller tube through the fabric-receiving opening to the second fabric end, the pleating assembly comprising first and second support bars oriented parallel to each other along a longitudinal axis of the pleating assembly, the pleating assembly further comprising a plurality of pleating elements for causing the shade fabric to assume a non-linear shape, the pleating elements coupled to the supports bars and spaced at intervals from each other, the pleating elements coupled to the first and second support bars extending towards the second and first support bars, respectively, such that the shade fabric assumes the non-linear shape.

26. The roller shade system of claim 25, wherein the pleating elements each comprise a projection defining a funnel-shaped structure, the support bars mounted with respect to each other such that the fabric-receiving opening is formed between the pleating elements connected to the support bars, and the fabric-receiving opening forms a serpentine path.

27. The roller shade system of claim 26 wherein each projection has a first depth at the top and a second depth at the bottom, the first and second depths measured perpendicularly to the longitudinal axis of the pleating assembly, the second depth greater than the first depth to assist in forming pleats in the shade fabric as the shade fabric hangs below the pleating assembly; and wherein each projection has a first width at the top and a second width at the bottom, the first and second widths measured along the longitudinal axis of the pleating assembly, the first width greater than the second width to assist in forming folds in the shade fabric as the shade fabric is wrapped around the roller tube.

28. The roller shade system of claim 25, wherein the pleating elements each comprise a projection defining a T-shaped structure, the support bars mounted with respect to each other such that the fabric-receiving opening is formed between the pleating elements connected to the support bars, and the fabric-receiving opening forms a serpentine path.

29. The roller shade system of claim 24, wherein the drive system comprises a motor drive system.

30. The roller shade system of claim 24, wherein the drive system comprises a manual drive system.

* * * * *